US005122834A

United States Patent [19]

Okamoto et al.

[11] Patent Number: 5,122,834

[45] Date of Patent: Jun. 16, 1992

[54] DEVELOPING APPARATUS FOR DETERMINING DECREASED CONCENTRATION OF TONER

[75] Inventors: Hiroshi Okamoto, Shinshiro; Chujiro Yokoyama, Toyokawa; Moriyoshi Matsushiro, Nagoya; Yasuhiro Kusuda, Toyokawa, all of Japan

[73] Assignee: Minolta Camera Kabushiki Kaisha, Osaka, Japan

[21] Appl. No.: 578,255

[22] Filed: Sep. 6, 1990

[30] Foreign Application Priority Data

Sep. 7, 1989 [JP] Japan ..... 1-232564
Sep. 7, 1989 [JP] Japan ..... 1-232565

[51] Int. Cl.[5] ..... G03G 15/08
[52] U.S. Cl. ..... 355/208; 355/246
[58] Field of Search ..... 355/208, 245, 246, 253; 118/688-690

[56] References Cited

U.S. PATENT DOCUMENTS 4,708,458 11/1987 Ueda et al. ..... 355/246 X
4,864,349 9/1989 Ito ..... 355/253

FOREIGN PATENT DOCUMENTS 62-28780 2/1987 Japan .
63-78182 4/1988 Japan ..... 355/246

*Primary Examiner*—Joan H. Pendegrass
*Attorney, Agent, or Firm*—Burns, Doane, Swecker & Mathis

[57] ABSTRACT

A developing apparatus comprising: a developing device for contacting an electrostatic image-bearing member with a development mix of toner and carrier particles; a first transporting member for transporting the mix to the developing device, a second transporting member for transporting the mix to the first transporting member; a third transporting member for transporting the mix to the second transporting member such that first and second circulations of the mix are, respectively, formed between the first and second transporting members and between the second and third transporting members; a sensor for producing a concentration signal having a value indicative of the ratio of toner in the mix of the first circulation, which is disposed in the first circulation of the mix; and a toner replenishing device for replenishing toner to the second circulation of the mix in response to the concentration signal such that the toner is replenished from an area except for the area corresponding to the second transporting member in the second circulation of the mix.

12 Claims, 10 Drawing Sheets

DEVELOPING APPARATUS FOR DETERMINING DECREASED CONCENTRATION OF TONER

BACKGROUND OF THE INVENTION

The present invention relates to a developing apparatus for a copier, a printer, etc. based on an electrophotographic process.

Conventionally, U.S. Pat. No. 4,864,349 has proposed a developing apparatus in which first, second and third transport passages are sequentially arranged in parallel and rearwards of a developing section provided with a developing sleeve such that developer is transported through its circulation by the first to third transport passages.

However, in this known developing apparatus, such a phenomenon may take place in which toner transported in each transport passage is used for development in a state where the toner is neither fully mixed in the developer nor electrically charged to a necessary value. In said developing apparatus, toner concentration in all of the transport passages is difficult to be desirably and uniformly maintained because toner concentration in each of the first to third passages would vary, thereby resulting in such drawbacks that fog appears on an image or powdery mist of the developer leaking out of the developing apparatus stains peripheral apparatuses.

SUMMARY OF THE INVENTION

Accordingly, an essential object of the present invention is to provide, with a view eliminating the disadvantages inherent in conventional developing apparatuses, a developing apparatus comprising: developing means for contacting an electrostatic image-bearing member with a development mix of toner and carrier particles; first transporting means for transporting the mix to the developing means, which is disposed adjacent to the developing means; second transporting means for transporting the mix to the first transporting means, which is disposed adjacent to the first transporting means; wherein some of the mix transported by the first transporting means is transported to the second transporting means, whereby a first circulation of the mix is formed between the first and second transporting means; and third transporting means for transporting the mix to the second transporting means, which is disposed adjacent to the second transporting means; wherein some of the mix transported by the second transporting means is transported to the third transporting means, whereby a second circulation of the mix is formed between the second and third transporting means; means for producing a concentration signal having a value indicative of the ratio of toner in the mix of the first circulation, which is disposed in the first circulation of the mix; and means for replenishing toner to the second circulation of the mix in response to the concentration signal such that the toner is replenished from an area except for the area corresponding to the second transporting means in the second circulation of the mix.

By the above described arrangement of the developing apparatus of the present invention, when drop of concentration of the toner has been detected based on the detection signal from the toner concentration detecting means, the toner is replenished to the third transport passage.

In other words, the state of the mix which actually contributes to the development can be obtained since said concentration signal is obtained from the first circulation by which the toner is directly supplied to the developing means. Additionally, toner is replenished to the area except for the area corresponding to the second transporting means in the second circulation. Thus, the toner concentration does not vary suddenly in the first circulation since the replenished toner is previously mixed in the second circulation so as to be electrically charged to a predetermined level, and then is supplied to the first circulation.

As apparent from the above, the toner concentration signal is accurately obtained from the first circulation and the toner which is replenished in accordance with accurate toner concentration signal is further mixed in the second circulation by the second and third transporting means. Therefore, the toner concentration of the first and second circulations is desirably maintained so as to eliminate the toner fog or powdery mist from the development.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout the accompanying drawings.

DETAILED DESCRIPTION OF THE INVENTION

Figure 1:
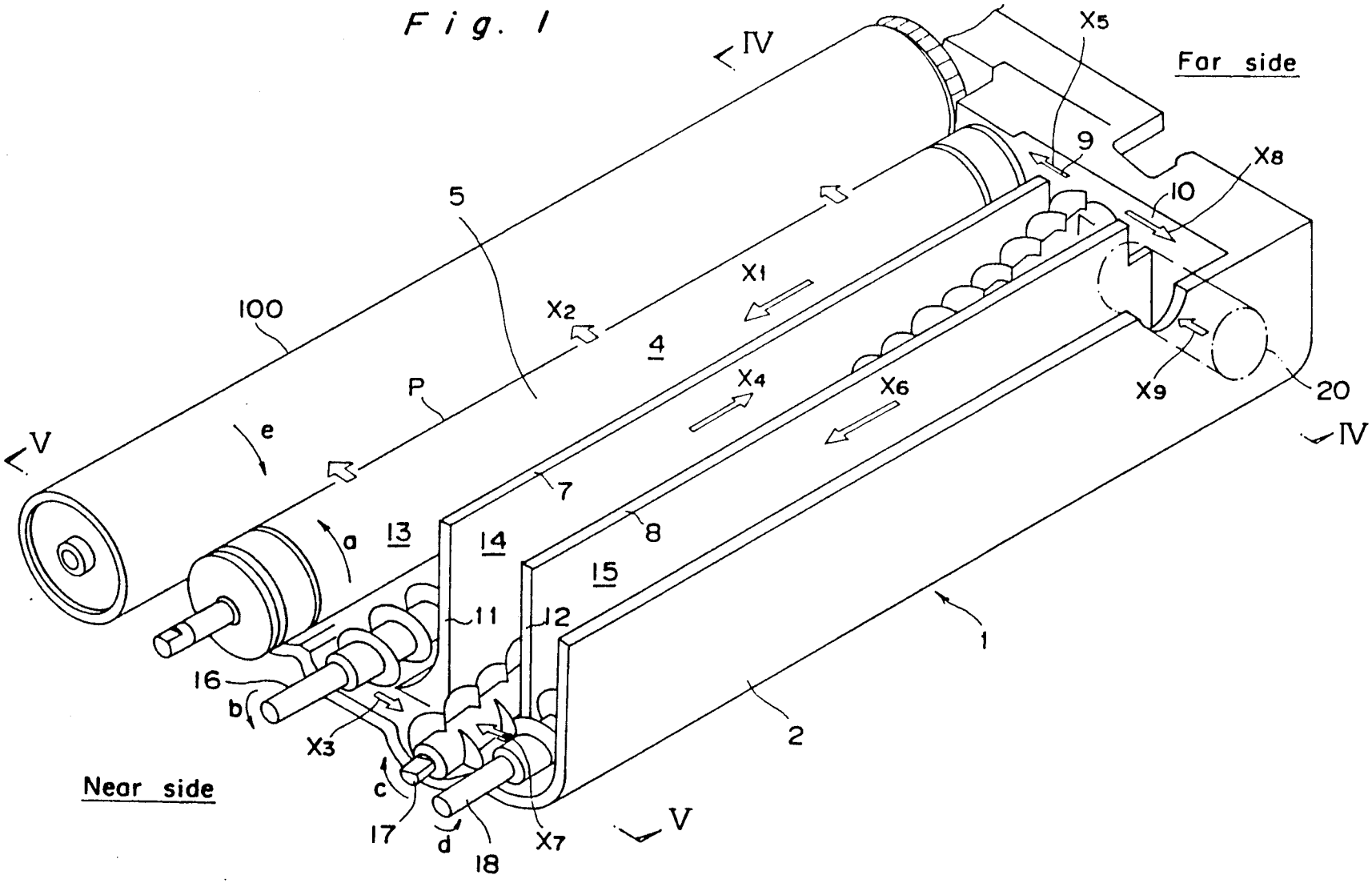
FIG. 1 is a partially cutaway perspective view of a developing apparatus according to a first embodiment of the present invention.
Figure 2:
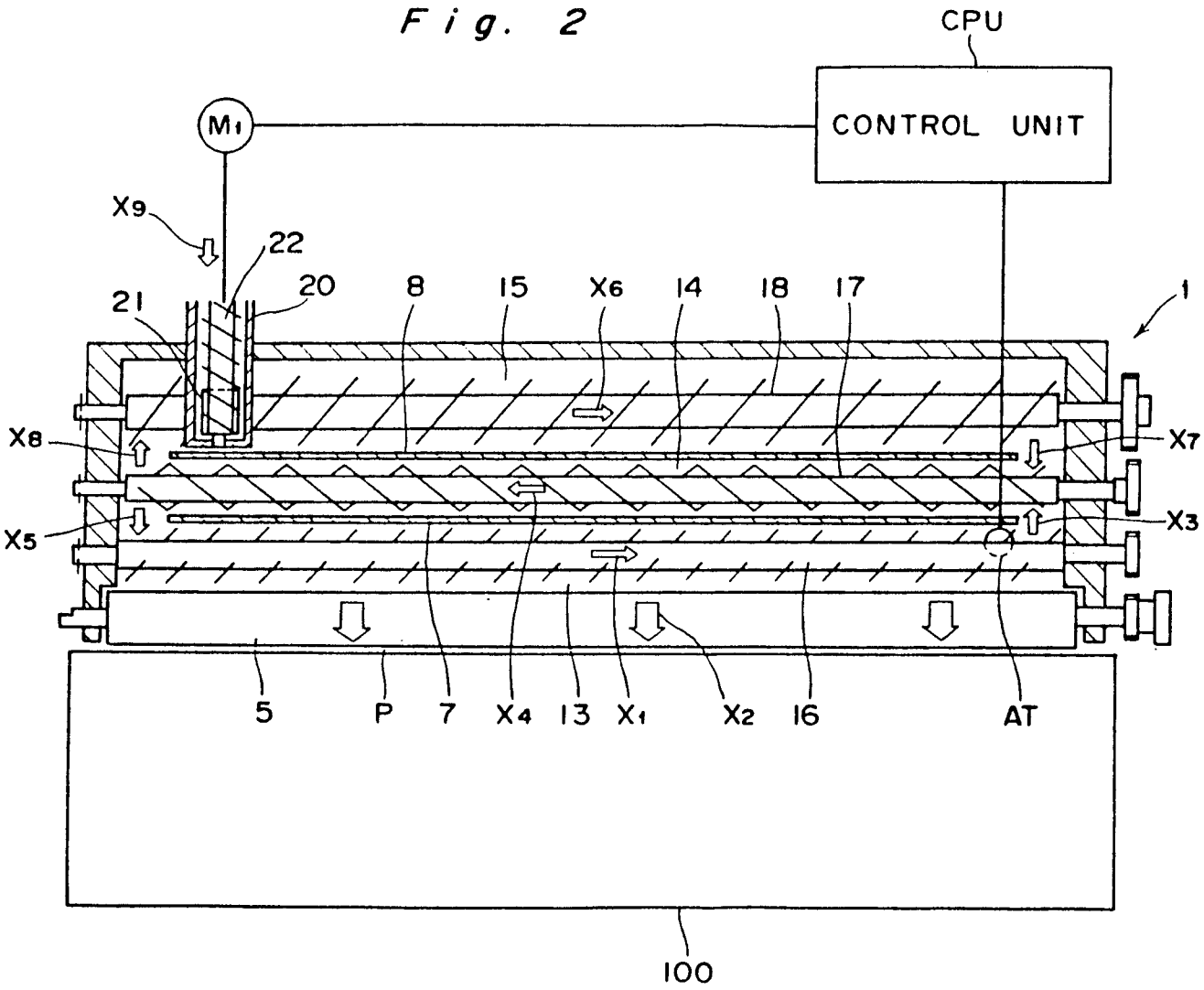
FIG. 2 is a longitudinal sectional sectional view of the developing apparatus of FIG. 1.

Referring now to the drawings, there is shown in FIGS. 1 to 5, a developing apparatus 1 according to a first embodiment of the present invention. The developing apparatus 1 has a housing constituted by a casing 2 and a cover 3. A developing section 4 is provided at a front portion of the developing apparatus 1. In the developing section 4, a cylindrical developing sleeve 5 is rotatably provided so as to be rotated in the direction of the arrow a. A magnetic member 6 having a plurality of axially extending magnetic poles N1, S1, N2, N3 and S2 is nonrotatably mounted in the developing sleeve 5.

Figure 4:
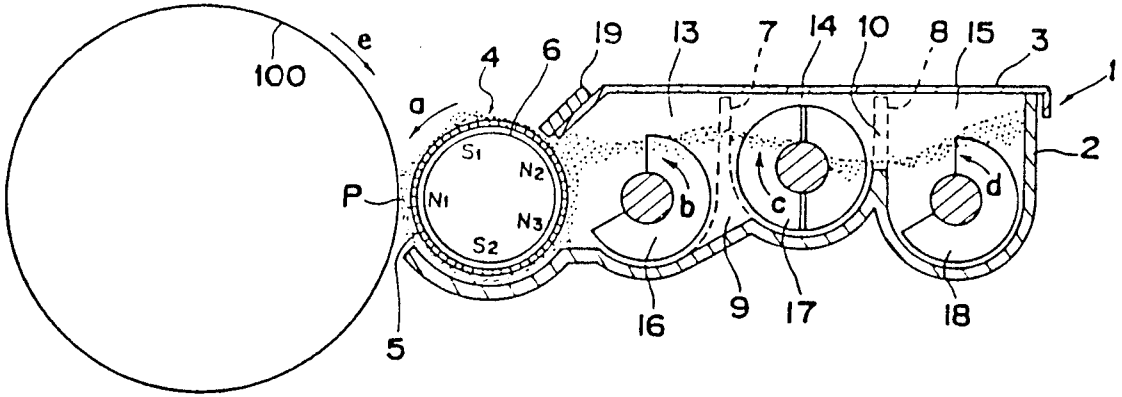
FIG. 4 is a sectional view taken along the line IV—IV in FIG. 1.
Figure 5:
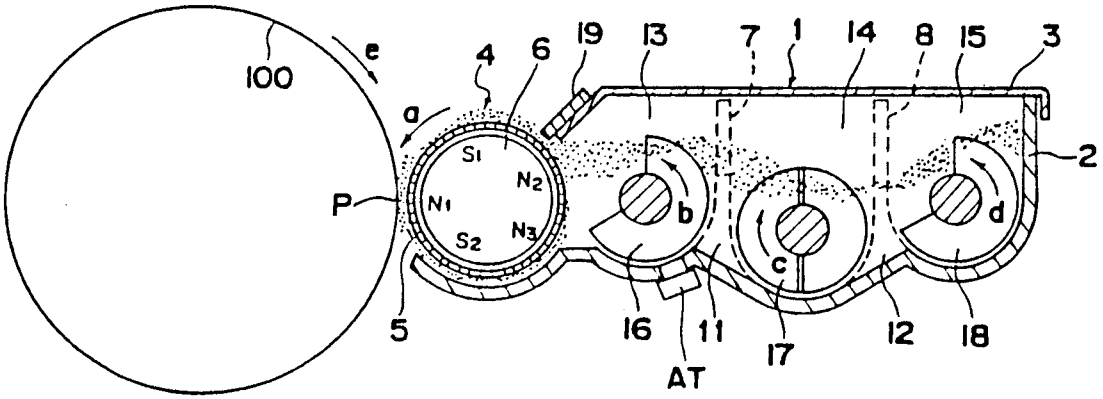
FIG. 5 is a sectional view taken along the line V—V in FIG. 1.

Rearwards of the developing section 4, first and second partition walls 7 and 8 extend upwardly from a bottom of the casing 2 so as to define first, second and third transport passages 13, 14 and 15 sequentially rearwards in this order. Bottom portions of the first and third transport passages 13 and 15 extend horizontally in parallel with an axis of the developing sleeve 5. On the other hand, as shown in FIGS. 4 and 5, a bottom portion of the second transport passage 14 is inclined with respect to a horizontal plane so as to be lower than those of the first and third transport passages 13 and 15 at one end of the developing apparatus 1, i.e. at the near side of FIG. 1 and higher than those of the first and third transport passages 13 and 15 at the other end of the developing apparatus 1, i.e. at the far side in FIG. 1. Furthermore, opposite end portions of the first partition wall 7 are cut off so as to define first and second passages 9 and 11 at the far and near sides in FIG. 1, respectively. Likewise, opposite end portions of the second partition wall 8 are cut off so as to define third and fourth passages 10 and 12 at the far and near sides in FIG. 1, respectively.

First, second and third screws 16, 17 and 18 are, respectively, rotatably provided in the first, second and third transport passages 13, 14 and 15 so as to be driven for rotation in the directions of the arrows b, c and d in FIG. 1 and are adapted to deliver developer contained in the first, second and third transport passages 13, 14 and 15 in the directions of the arrows X1, X4 and X6, respectively.

A toner replenishment tube 20 having a drop feed port 21 is connected to a toner hopper (not shown) such that the drop feed port 21 is disposed in the third transport passage 15. A screw 22 is provided in the toner replenishment tube 20 and is driven for rotation by a toner replenishment motor M1 so as to feed the toner in the direction of the arrow X9.

A toner concentration sensor AT for measuring inductance of the developer is provided at the near-side end portion of the bottom portion of the first transport passage 13.

In the above described arrangement of the developing apparatus 1, the developer composed of toner and carrier mixed with each other is accommodated in the first, second and third transport passages 13, 14 and 15.

The developer in the third transport passage 15 is transported in the direction of the arrow X6 by the third screw 18 so as to be carried to the near-side end of the second transport passage 14 in the direction of the arrow X7 through the fourth passage 12.

The developer in the second transport passage 14 is transported in the direction of the arrow X4 by the second screw 17 so as to be distributed, at the far-side end of the second transport passage 14, to the first and third transport passages 13 and 15 in the directions of the arrows X5 and X8 through the first and third passages 9 and 10.

The developer in the first transport passage 13 is transported in the direction of the arrow X1 by the first screw 16 so as to be fed to the near-side end of the second transport passage 14 in the direction of the arrow X3 through the second passage 11. The developer in the first transport passage 13 is supplied to the developing sleeve 5 while being transported in the direction of the arrow X1.

The developer supplied to the developing sleeve 5 is conveyed, through regulation of amount of transport of the developer by a bristle height regulating member 19, to a developing region P in the direction of the arrow a in FIG. 1 (arrows X2 in FIGS. 2, 3*a* and 3*b*) upon rotation of the developing sleeve 5 while being held onto an outer peripheral portion of the developing sleeve 5 owing to magnetic force of the magnetic member 6. The developer carried to the developing region P is brought into contact with an outer peripheral surface of a photosensitive member 100 rotating in the direction of the arrow e so as to supply toner to an electrostatic latent image formed thereon.

The developer having passed through the developing region P is transported in the direction of the arrow a (arrow X2' in FIGS. 3*a* and 3*b*) by rotation of the developing sleeve 5 and is released from the outer peripheral portion of the developing sleeve 5 at a region confronting a bridging portion of the magnetic member 6 between the magnetic poles N2 and N3 of the same polarity so as to be mixed into the developer transported in the first transport passage 13.

Hereinbelow, control of replenishment of toner is described. A signal from the toner concentration sensor AT is inputted to a control unit CPU and concentration of toner of the developer at the toner concentration sensor AT is detected from voltage of the signal. The concentration of toner detected by the toner concentration sensor AT is compared with a target value to be controlled, for example 6%. If the concentration of toner is lower than the target value, the toner replenishment motor M1 is rotated and thus, toner carried in the direction of the arrow X9 is replenished to the third transport passage 15 through the drop feed port 21. The replenished toner in the third transport passage 15 is delivered in the direction of the arrow X6 by the third screw 18 together with the developer transported in the third transport passage 15. At this time, the toner is mixed with the developer and is electrically charged through its contact with the carrier such that quantity of electric charge on the toner is increased. The toner carried to the near-side end of the third transport passage 15 is conveyed into the second transport passage 14 through the fourth passage 12 and is transported in the direction of the arrow X4 by the second screw 17 together with the developer fed from the first transport passage 13 to the second transport passage 14 through the second passage 11 and is further mixed with the developer in the second transport passage 14 so as to be dispersed such that its quantity of electric charge is increased.

When the developer is transported in the first transport passage 13, concentration of the toner of the developer is detected by the toner concentration sensor AT. If the toner concentration sensor AT detects that amount of the toner is insufficient, the toner replenishment motor M1 is further driven so as to replenish the toner into the third transport passage 15.

The developer carried to the far-side end of the second transport passage 14 is distributed to the first and third passages 9 and 10 so as to be introduced into the first and third transport passages 13 and 15 such that the developer fed into the first transport passage 13 is used for development while being transported in the direction of the arrow X1. Meanwhile, while being conveyed in the third and second transport passages 15 and 14, the toner replenished into the third transport passage 15 is sufficiently mixed with the developer and is uniformly dispersed so as to be electrically charged. Therefore, such phenomena do not take place that the toner transported to the developing region P is scattered away from the carrier and adheres to an image nonforming portion of the photosensitive member 100. Accordingly, the toner adheres to an electrostatic latent image uniformly at any region of the photosensitive member 100.

Figure 3A:
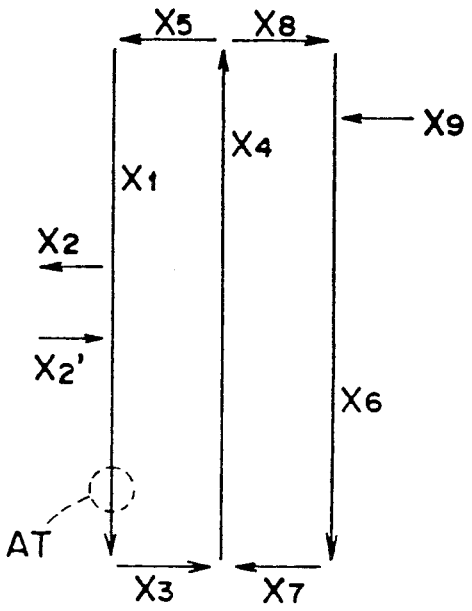
FIG. 3*a* is a view explanatory of flow of developer in the developing apparatus of FIG. 1.
Figure 3B:
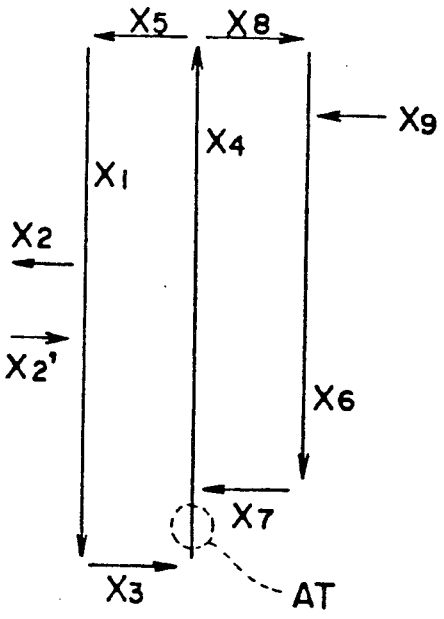
FIG. 3*b* is a view similar to FIG. 3*a*, particularly showing a modification thereof.

Meanwhile, in the above described arrangement, the toner concentration sensor AT is provided at the near-side end portion of the first transport passage 13. However, it can also be so modified as shown in FIG. 3*b* that the toner concentration sensor AT is provided in the second transport passage 14 so as to be disposed, in the direction of the arrow X4, upstream of a location at which the toner replenished into the third transport passage 15 is mixed with the developer in the second transport passage 14.

As is clear from the foregoing description, the present invention provides the developing apparatus which includes the first, second and third transport passages arranged in parallel and rearwards of the developing section such that the developer is transported through its circulation by the first to third transport passages and in which the toner concentration sensor is provided at a downstream side in the direction of transport of the developer in the first transport passage or in the second transport passage such that the toner is replenished into the third transport passage on the basis of detection result of the toner concentration sensor.

Accordingly, the toner replenished into the third transport passage is mixed with the developer in the third and second transport passages, uniformly dispersed and electrically charged sufficiently so as to be used for development in the first transport passage.

Therefore, since the toner is coupled with the carrier with large bonding force, the toner is held onto the carrier without being scattered away from the carrier. Furthermore, since the toner is distributed at uniform concentration throughout the developing region, it is possible to obtain a clear image free from nonuniformity of concentration of the toner.

Figure 6:
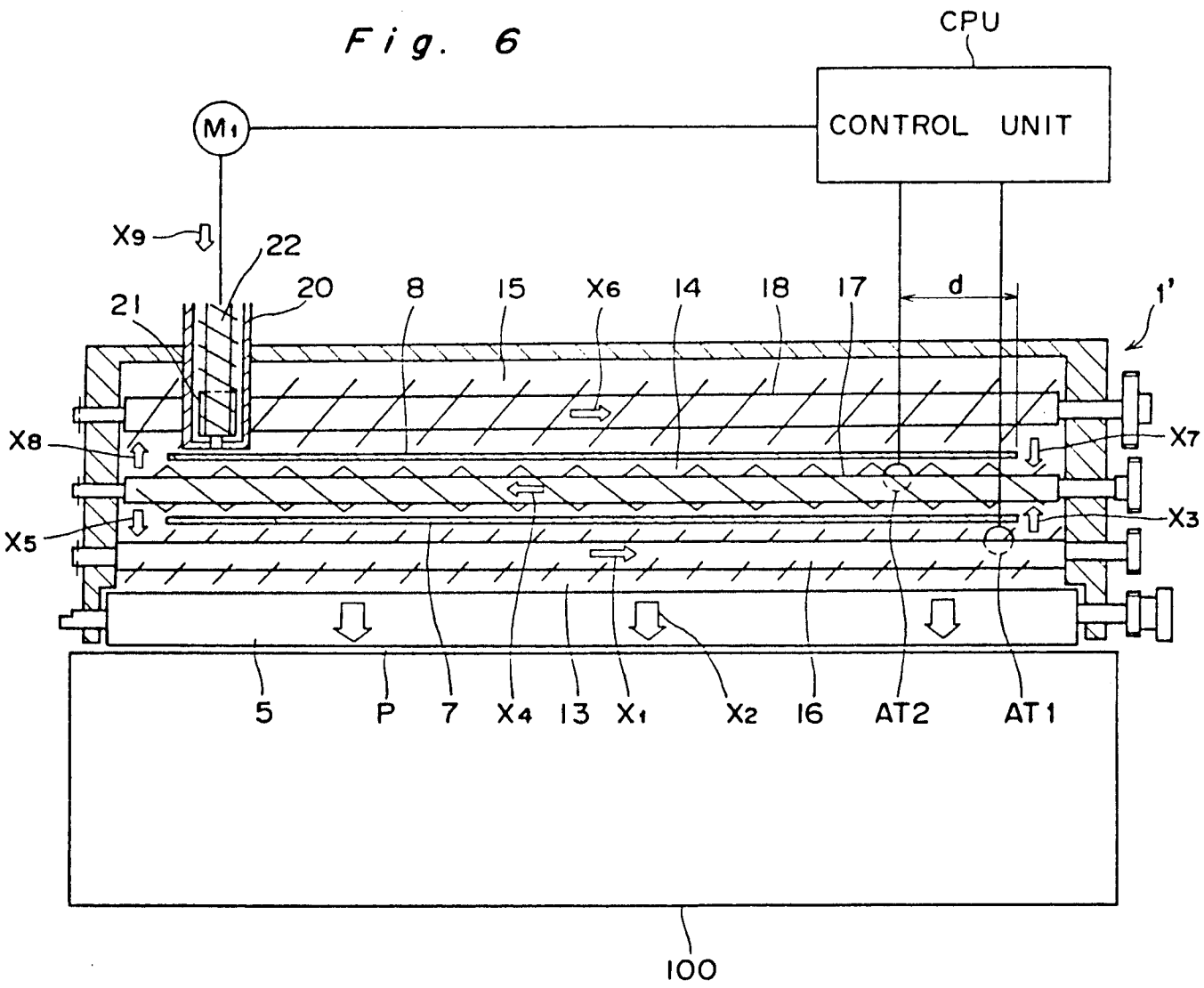
FIGS. 6 and 7 are views similar to FIGS. 2 and 3*a*, respectively, particularly showing a second embodiment of the present invention.
Figure 7:
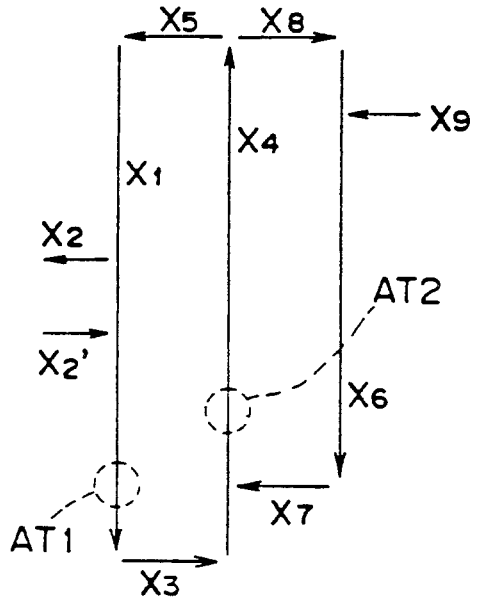
Figure 8:
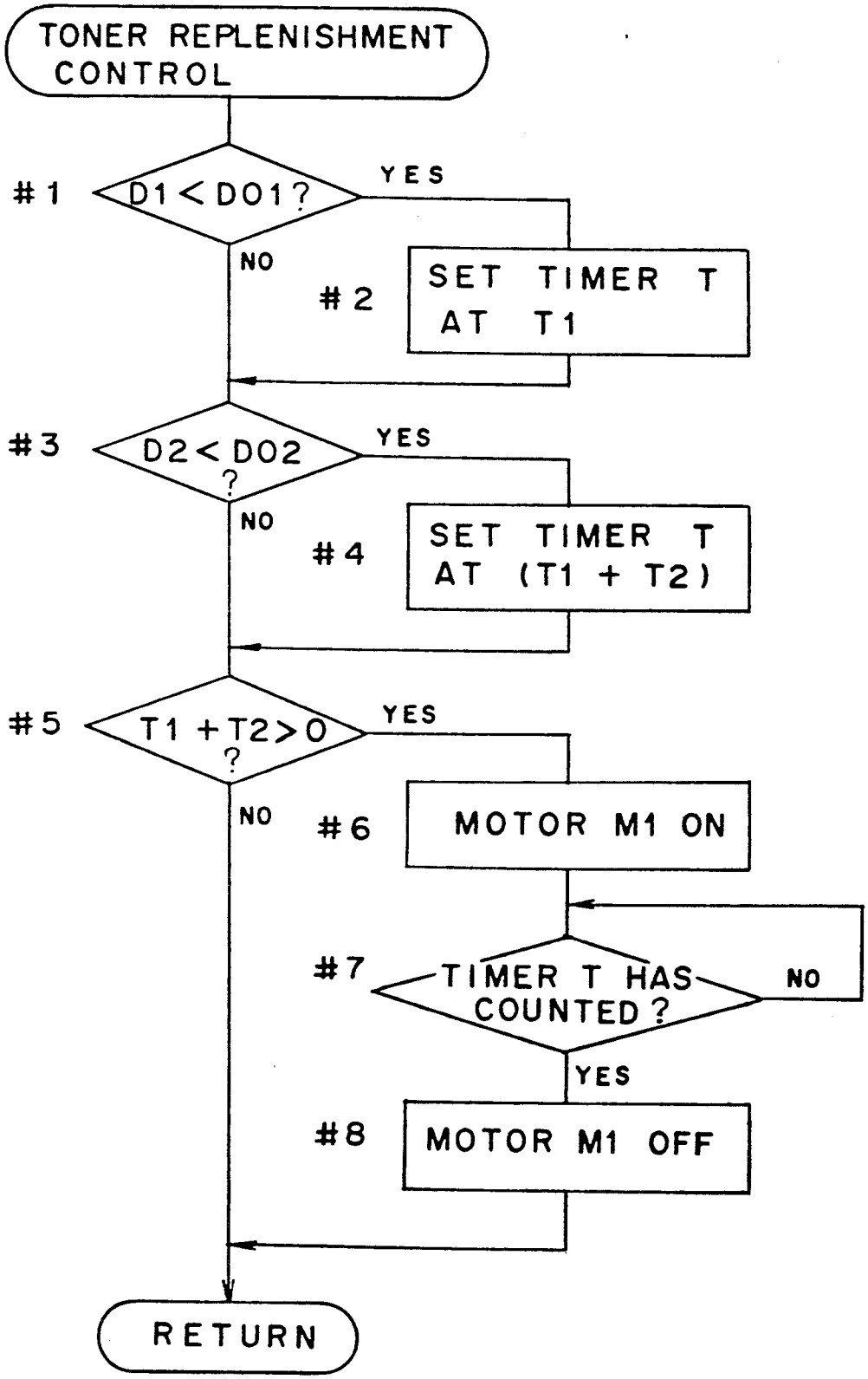
FIG. 8 is a flowchart showing control of replenishment of toner in the developing apparatus of FIG. 6.

Referring to FIGS. 6 to 8, there is shown a developing apparatus 1' according to a second embodiment of the present invention. The developing apparatus 1' includes toner concentration sensors AT1 and AT2. As shown in FIG. 6, the toner concentration sensor AT1 is provided at the near-side end portion of the bottom portion of the first transport passage 13, while the toner concentration sensor AT2 is provided on the bottom portion of the second transport passage 14 so as to be spaced a predetermined distance d from the near-side end portion of the second transport passage 14. Since other constructions of the developing apparatus 1' are similar to those of the developing apparatus 1, description thereof is abbreviated for the sake of brevity.

Hereinbelow, control of replenishment of the toner is described with reference to the flowchart of FIG. 8. Signals from the toner concentration sensors AT1 and AT2 are inputted to the control unit CPU and concentrations D1 and D2 of the toner at the toner concentration sensors AT1 and AT2 are detected from voltages of the signals. At step #1, it is judged whether or not the concentration D1 of the toner detected by the sensor AT1 in the first transport passage 13 is smaller than a target value D01 of 6% to be controlled. In the case of "YES" at step #1, the program flow proceeds to step #2 followed by step #3. On the other hand, in the case of "NO" at step #2, the program flow proceeds directly to step #3. At step #2, a preset period of a timer T for driving the toner replenishment motor M1 for the preset period is set at a value of T1 given by the following equation in which character $\alpha$ denotes a coefficient.

$$T1 = \alpha \cdot (D1 - D01)$$

At step #3, a decision is made as to whether or not the concentration D2 of the toner detected by the sensor AT2 in the second transport passage 14 is smaller than a target value D02 of 6% to be controlled. In the case of "YES" at step #3, the program flow proceeds to step #4 followed by step #5. On the contrary, in the case of "NO" at step #4, the program flow proceeds directly to step #5. At step #4, the preset period of the timer T is changed to a value of (T1+T2) in which T2 is given by the following equation.

$$T2 = \beta \cdot (D2 - D02)$$

In the above equation, character $\beta$ denotes a coefficient smaller than the coefficient $\alpha$, i.e. $\beta < \alpha$. At step #5, it is judged whether or not the value of (T1+T2) is larger than zero. In the case of "YES" at step #5, namely when the preset period of the timer T has been set at step #2 and/or step #4, the toner replenishment motor M1 is driven at step #6, so that the toner is transported in the toner replenishment tube 20 in the direction of the arrow X9 so as to be fed to the third transport passage 15 from the drop feed port 21. Then, if it is decided at step #7 that the timer T has completed time counting, the toner replenishment motor M1 is stopped at step #8 and then, the program flow returns to a main control routine (not shown).

Meanwhile, the coefficient $\beta$ is so set as to be smaller than the coefficient $\alpha$ as described above. Therefore, in response to drop of concentration of the toner, the toner is replenished mainly based on measurements of the sensor AT1. Variations in amount of replenishment of the toner in this toner replenishment based on measurements of the sensor AT1 are corrected by toner replenishment based on measurements of the sensor AT2, so that the toner is stably supplied in response to drop of concentration of the toner. Meanwhile, when it is decided from the measurements of the sensor AT2 that the concentration D2 of the toner is smaller than the target value D02 even if it has been judged from the measurements of the sensor AT1 that the concentration D1 of the toner is smaller than the target value D01, the toner is replenished in accordance with the difference between the concentration D2 and the target value D02, thereby resulting in precise control of concentration of the toner.

Furthermore, the replenished toner is sufficiently mixed with the developer in the third transport passage 15 and then, is fed to the second transport passage 14 so as to be supplied to the developer having a lowered concentration of the toner. Namely, in the second transport passage 14, the developer having a lowered concentration of the toner is mixed with the developer replenished with the toner. As a result, such an undesirable phenomenon does not take place that a lump of the toner is supplied to the developer having a lowered concentration of the toner in the second transport passage 14, thus eliminating abnormal local rise of concentration of the toner.

Figure 9:
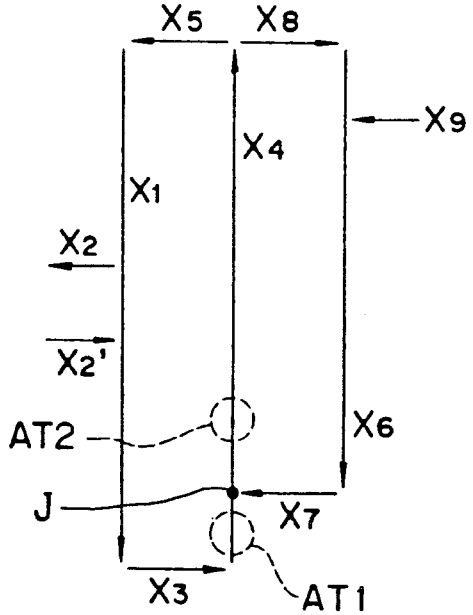
FIG. 9 is a view similar to FIG. 7, particularly showing a modification thereof.

In the foregoing, the sensor AT1 is provided in the first transport passage 13 so as to detect concentration of the toner in the first transport passage 13. However, it can also be so arranged as shown in FIG. 9 that the sensor AT1 is provided in the second transport passage 14 in the same manner as the sensor AT2 so as to detect concentration of the toner in the second transport passage 14. It is to be noted that in this case, the sensor AT1 is required to be provided, in the direction of the arrow X4, upstream of a junction J of the flow of the developer in the direction of the arrow X4 and the flow of the developer in the direction of the arrow X7. Furthermore, the sensor AT1 may also be provided in the second passage 11.

Figure 10:
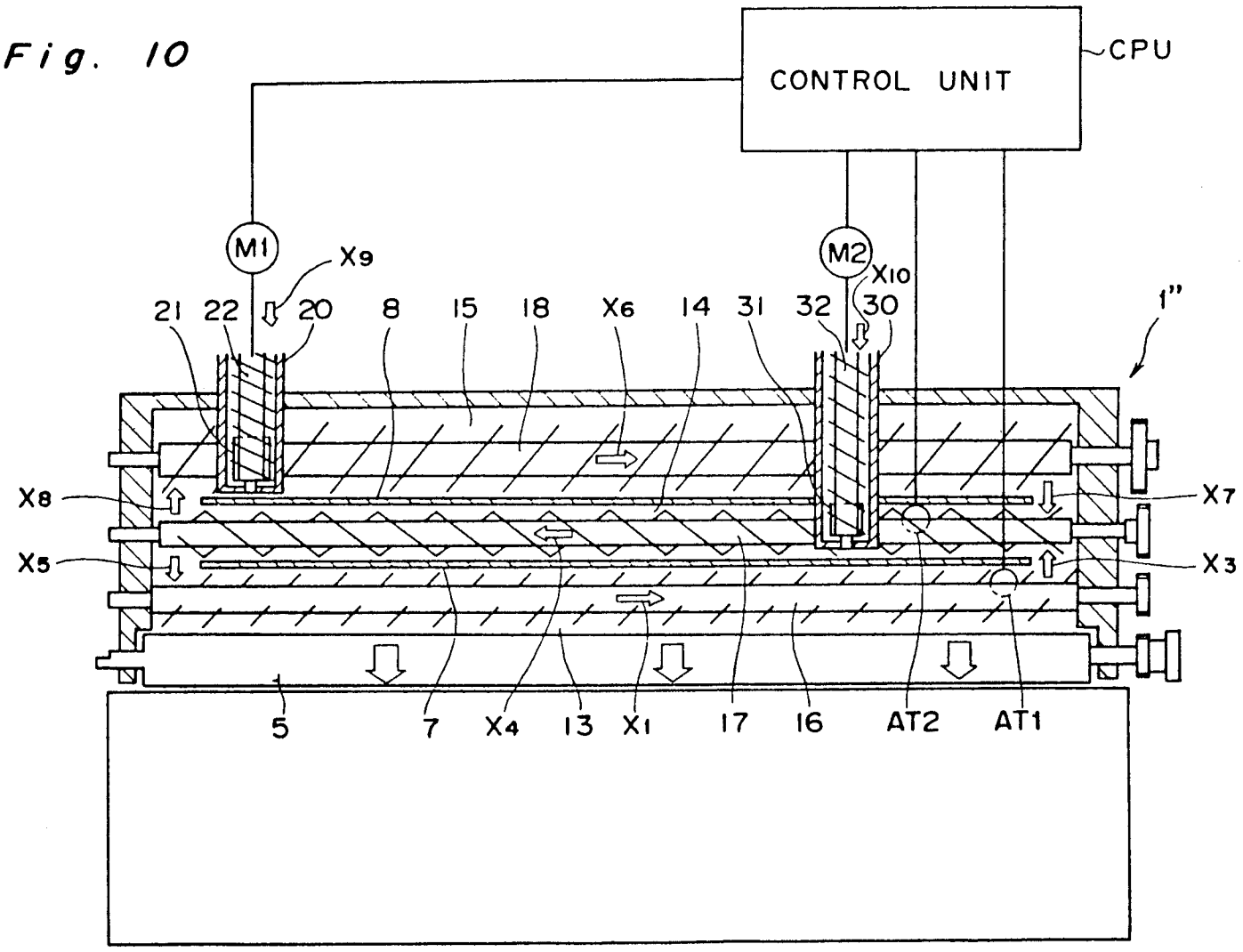
FIGS. 10 and 11 are views similar to FIGS. 6 and 7, respectively, particularly showing a third embodiment of the present invention.
Figure 11:
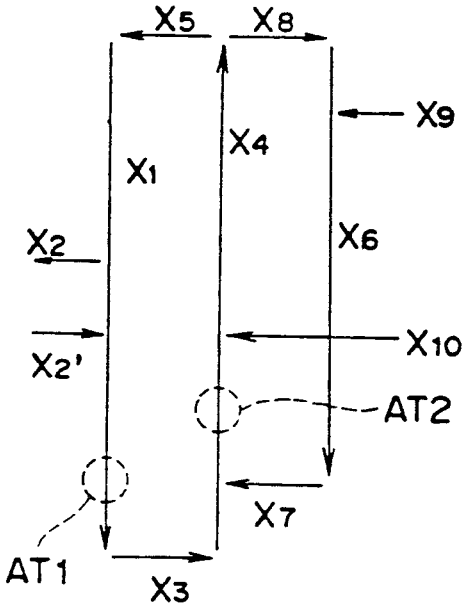
Figure 12:
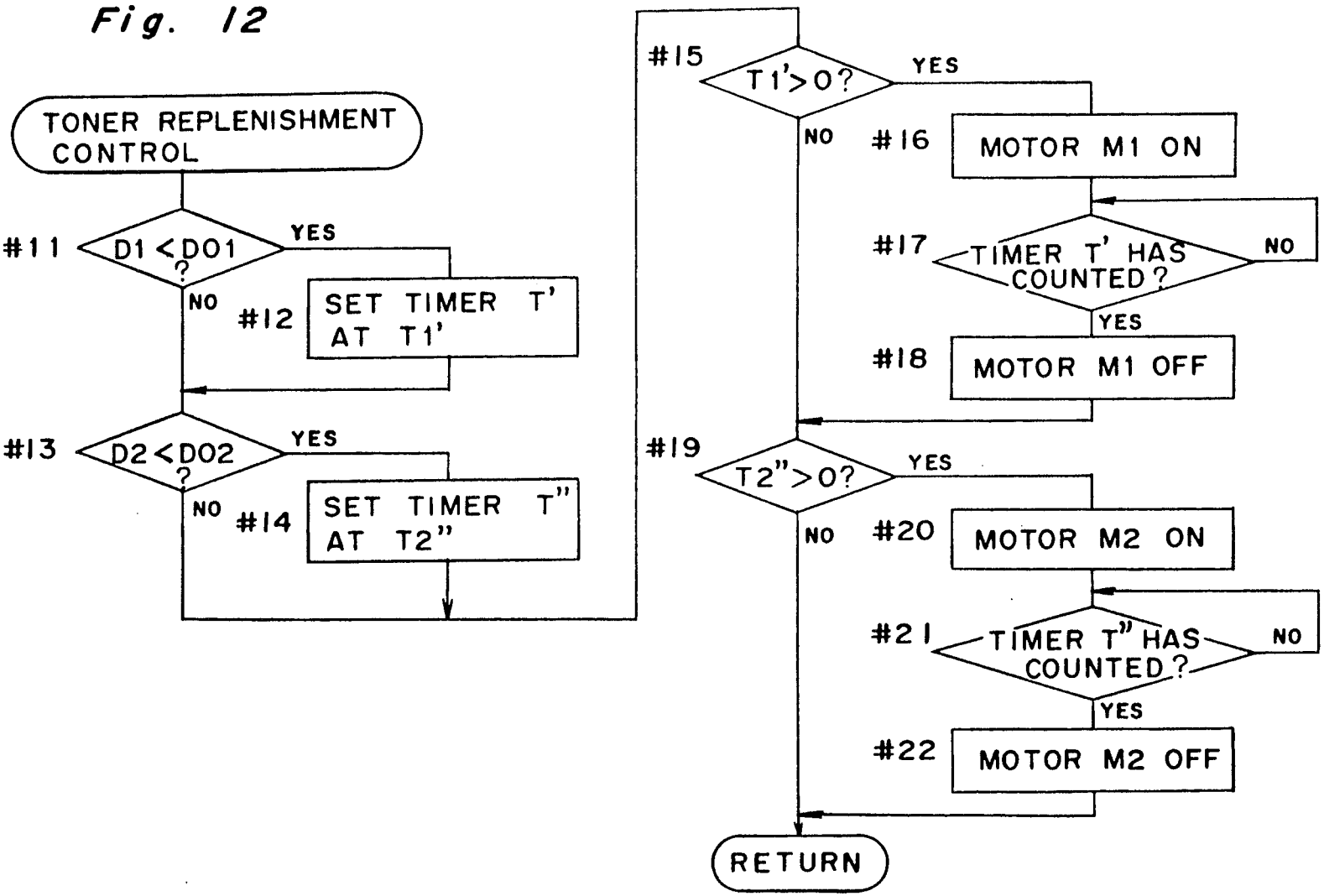
FIG. 12 is a flowchart showing control of replenishment of toner in the developing apparatus of FIG. 10.

Referring further to FIGS. 10 to 12, there is shown a developing apparatus 1'' according to a third embodiment of the present invention. In addition to the toner replenishment tube 20, the developing apparatus 1'' includes a further toner replenishment tube 30. In the same manner as in the developing apparatus 1', the sensors AT1 and AT2 are, respectively, provided in the first and second transport passages 13 and 14 and the drop feed port 21 of the toner replenishment tube 20 is disposed in the third transport passage 15. Meanwhile, a drop feed port 31 of the further toner replenishment tube 30 is provided in the second transport passage 14 and downstream of the sensor AT2 in the direction of the arrow X4. In the same manner as in the toner replenishment tube 20, the further toner replenishment tube 30 is coupled with the toner hopper (not shown) and a screw 32 provided in the further toner replenishment tube 30 is driven for rotation by a toner replenishment motor M2 so as to feed the toner in the direction of the arrow X10.

Hereinbelow, control of replenishment of the toner in the developing apparatus 1'' is described with reference to the flowchart of FIG. 12. Signals from the sensors AT1 and AT2 are inputted to the control unit CPU and the concentrations D1 and D2 of the toner at the sensors AT1 and AT2 are detected from voltages of the signals. At step #11, it is judged whether or not the concentration D1 of the toner detected by the sensor AT1 in the first transport passage 13 is smaller than the target value D01 of 6% to be controlled. In the case of "YES" at step #11, the program flow proceeds to step #12 followed by step #13. On the contrary, in the case of "NO" at step #11, the program flow proceeds directly to step #13. At step #12, a preset period of a timer T' for driving the toner replenishment motor M1 for the preset period is set at a value of T1' given by the following equation in which character $\alpha$ denotes a coefficient.

$$T1' = \alpha \cdot (D1 - D01)$$

At step #13, it is decided whether or not the concentration D2 of the toner detected by the sensor AT2 in the second transport passage 14 is smaller than the target value D02 of 6% to be controlled. In the case of "YES" at step #13, the program flow proceeds to step #14 followed by step #15. On the other hand, in the case of "NO" at step #13, the program flow proceeds directly to step #15. At step #14, a preset period of a timer T'' for driving the toner replenishment motor M2 for the preset period is set at a value of T2'' given by the following equation in which character $\beta$ denotes a coefficient smaller than the coefficient $\alpha$, i.e. $\beta < \alpha$.

$$T2'' = \beta \cdot (D2 - D02)$$

AT step #15, it is judged whether or not the value of T1' is larger than zero. In the case of "YES" at step #15, namely when the preset period of the timer T' has been set at step #12, the toner replenishment motor M1 is driven at step #16. Subsequently, if it is found at step #17 that the timer T' has completed time counting, the toner replenishment motor M1 is stopped at step #18 followed by step #19. On the other hand, in the case of "NO" at step #15, namely when the preset period of the timer T' has not been set at step #12, the program flow proceeds directly to step #19.

Thereafter, at step #19, a decision is made as to whether or not the value of T2'' is larger than zero. In the case of "YES" at step #19, namely when the preset period of the timer T'' has been set at step #14, the toner replenishment motor M2 is driven at step #20 and then, it is judged at step #21 whether or not the timer T'' has completed time counting. In the case of "YES" at step #21, the toner replenishment motor M2 is stopped at step #22 and then, the program flow returns to a main routine (not shown). Meanwhile, also in the case of "NO" at step #19, namely when the preset period of the timer T'' has not been set at step #14, the program flow returns to the main routine.

By the above described processing, concentration of the toner of the developer in which the toner has been consumed for development is detected by the sensor AT1 and the toner is replenished from the toner replenishment tube 20 in accordance with the detection result of the sensor AT1. Then, concentration of the toner of the developer which has been replenished with the toner is detected by the sensor AT2 and the toner is replenished from the further toner replenishment tube 30 in accordance with the detection result of the sensor AT2 such that variations in amount of replenishment of the toner by the toner replenishment tube 20 are corrected.

Figure 13:
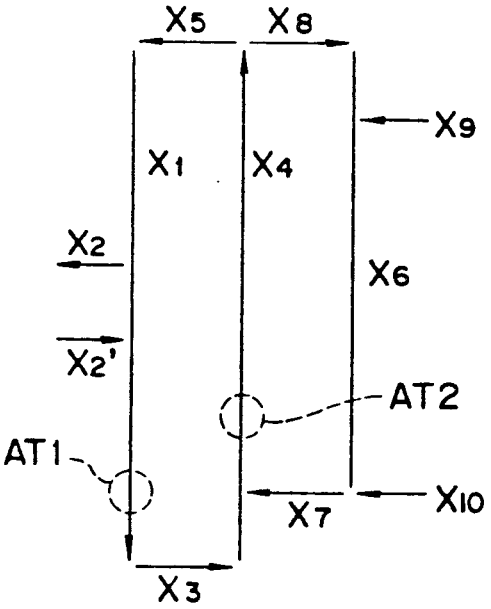
FIG. 13 is a view similar to FIG. 11, particularly showing a modification thereof.

Meanwhile, in this embodiment, the drop feed port 31 of the further toner replenishment tube 30 is provided in the second transport passage 14 and downstream of the sensor AT2 in the direction of the arrow X4. However, it can also be so arranged as shown in FIG. 13 that the drop feed port 31 of the further toner replenishment tube 30 is provided in the third transport passage 15 and downstream of the drop feed port 21 of the toner replenishment tube 20 in the direction of the arrow X6. In this case, the sensor AT2 is adapted to measure concentration of the toner of the developer in which variations in amount of replenishment of the toner by the toner replenishment tube 20 have been corrected by the toner replenishment tube 30.

In the above embodiments, the present invention is applied to the developing apparatus including the three transport passages 13, 14 and 15 disposed rearwards of the developing sleeve 5. However, the present invention is also applicable, needless to say, to a developing apparatus which is not provided with the third transport passage 15.

As is clear from the foregoing description, in the developing apparatus according to the second and third embodiments of the present invention, concentration of the toner of the developer in which concentration of the toner has dropped due to consumption of the toner for development is detected by the first toner concentration detecting means, while concentration of the toner of the developer which has been replenished with the toner is detected by the second toner concentration detecting means such that the toner is replenished on the basis of the detection results of the first and second toner concentration detecting means. Namely, concentration of the toner is controlled on the basis of both concentration of the toner of the developer prior to replenishment of the toner and concentration of the toner of the developer after replenishment of the toner.

Accordingly, in the second and third embodiments of the present invention, since amount of replenishment of the toner can be corrected based on concentration of the toner of the developer which has been replenished with the toner, variations in amount of replenishment of the toner are lessened in comparison with an arrangement in which concentration of the toner is controlled on the basis of only concentration of the toner of the developer prior to replenishment of the toner.

Furthermore, in the second and third embodiments of the present invention, concentration of the toner of the developer after completion of development is measured. If this measurement is smaller than a target value, replenishment of the toner is performed initially. Thus, in contrast with an arrangement in which concentration of the toner is controlled based on only concentration of the toner of the developer which has been replenished with the developer, such a drawback is eliminated that concentration of the toner of the developer varies owing to time lag from replenishment of the toner to detection of concentration of the toner of the developer.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed a being included therein.

What is claimed is:

1. A developing apparatus comprising:

developing means for contacting an electrostatic image-bearing member with a development mix of toner and carrier particles;

first transporting means for transporting the mix to the developing means, which is disposed adjacent to the developing means;

second transporting means for transporting the mix to the first transporting means, which is disposed adjacent to the first transporting means;

wherein some of the mix transported by the first transporting means is transported to the second transporting means, whereby a first circulation of the mix is formed between the first and second transporting means;

third transporting means for transporting the mix to the second transporting means, which is disposed adjacent to the second transporting means;

wherein some of the mix transported by the second transporting means is transported to the third transporting means, whereby a second circulation of the mix is formed between the second and third transporting means;

means for producing a concentration signal having a value indicative of the ratio of toner in the mix of the first circulation, which is disposed in the first circulation of the mix; and means for replenishing toner to the second circulation of the mix in response to the concentration signal such that the toner is replenished from an area except for the area corresponding to the second transporting means in the second circulation of the mix.

2. A developing apparatus as claimed in claim 1, further comprising means for comparing the value of the concentration signal with a predetermined value and for controlling the actuation of the means for replenishing the toner according to the comparing result so that the toner is replenished to the second circulation when the value of the concentration signal is lower than the predetermined value.

3. A developing apparatus comprising:

developing means for contacting an electrostatic image-bearing member with a development mix of toner and carrier particles;

first transporting means for transporting the mix to the developing means, which is disposed adjacent to the developing means;

second transporting means for transporting the mix to the first transporting means, which is disposed adjacent to the first transporting means;

wherein some of the mix transported by the first transporting means is transported to the second transporting means, whereby a first circulation of the mix is formed between the first and second transporting means;

third transporting means for transporting the mix to the second transporting means, which is disposed adjacent to the second transporting means;

wherein some of the mix transported by the second transporting means is transported to the third transporting means, whereby a second circulation of the mix is formed between the second and third transporting means;

a toner monitor for producing a concentration signal having a value characteristic of a condition of the mix, which is disposed in the first circulation of the mix;

replenishing means which has a first state for replenishing toner to the second circulation of the mix from an area except for the area corresponding to the second transporting means in the second circulation of the mix and a second state for inhibiting the toner replenishment of the first state; and means for controlling the operation of the replenishing means according to the value of the concentration signal so that the replenishing means is actuated in the first state having the value of the concentration signal lower than a predetermined value but is actuated in the second state having the value of the concentration signal higher than said predetermined value.

4. A developing apparatus as claimed in claim 3, wherein the toner monitor monitors the value of inductance of the mix.

5. An image forming method comprising:

a developing step of developing an electrostatic latent image by a development mix of toner and carrier, said mix being supported on a developing member;

a first forming step of forming a first circulation of the mix, said first circulation contacting the developing member so as to supply the mix to the developing member;

a second forming step of forming a second circulation of the mix, said second circulation contacting the first circulation at a first area and a second area wherein the mix of the second circulation moves from the first circulation to the second circulation so as to migrate the first circulation to the second circulation and to interchange the mix with the mix in the first circulation;

a producing step of producing a concentration signal having a value indicative of the ratio of toner in the mix of the first circulation; and a replenishing step of replenishing toner to the second circulation of the mix in response to the concentration signal;

wherein the toner is replenished from an area of the second circulation except for the area between the first area and the second area.

6. A developing apparatus comprising:

a developing roller for contacting an electrostatic image-bearing member with a developing mix of toner and carrier particles, said developing roller rotating with respect to a rotating axis and extending along the rotating axis;

first transporting means, disposed parallel to the rotating axis, for transporting the mix from a first area to a second area in a first region to move the mix in a moving direction which is parallel to the rotating axis;

wherein the developing roller contacts the mix in the first region so as to be supplied with the mix;

second transporting means, disposed parallel to the rotating axis, for transporting the mix from the second area to the first area in a second region to move the mix in a direction opposite to the moving direction, said second region being communicated with the first region at the first and second areas so as to form a circulation of the mix;

means for producing a first toner-concentration signal, which is disposed in the first region;

means for producing a second toner-concentration signal, which is disposed in the second region; and means for replenishing toner into the mix of the second region according to the first and second toner-concentration signals.

7. A developing apparatus as claimed in claim 6, wherein the means for replenishing toner has an opening for replenishing toner therethrough, said opening being disposed adjacent to the second area.

8. A developing apparatus comprising:

developing means for contacting an electrostatic image-bearing member with a development mix of toner and carrier particles;

first transporting means for transporting the mix from a first area to a second area in a first region;

wherein the developing means contacts the mix in the first region so as to be supplied with the mix;

second transporting means for transporting the mix from the second area to the first area in a second region, said second region being communicated with the first region at the first and second areas so as to form a circulation of the mix;

means for producing a first toner-concentration signal, which is disposed in the first region;

means for producing a second toner-concentration signal, which is disposed in the second region; and means for replenishing toner into the mix of the second region according to the first and second toner-concentration signals;

wherein the means for replenishing toner has two openings for replenishing toner therethrough, the openings being, respectively, disposed, in the transporting direction of the mix in the second region, upstream of the downstream of the means for producing the second toner-concentration signal;

means for replenishing toner into the mix of the second circulation of the mix according to the first and second toner-concentration signals.

9. A developing apparatus comprising:

developing means for contacting an electrostatic image-bearing member with a developing mix of toner and carrier particles;

first transporting means for transporting the mix from a first area to a second area in a first region;

wherein the developing means contacts the mix in the first region so as to be supplied with the mix;

second transporting means for transporting the mix from the second area to the first area in a second region, said second region being communicated with the first region at the first and second areas so as to form a first circulation of the mix between the first transporting means and the second transporting means;

third transporting means for transporting the mix from the first area to the second area in a third region, said third region being communicated with the second region at the first and second areas so as to form a second circulation of the mix between the second transporting means and the third transporting means;

means for producing a first toner-concentration signal, which is disposed in the first region;

means for producing a second toner-concentration signal, which is disposed in the second region; and means for replenishing toner into the mix of the second circulation of the mix according to the first and second toner-concentration signals.

10. A developing apparatus as claimed in claim 9, wherein the means for replenishing toner has an opening for replenishing toner therethrough, said opening being disposed in the third region.

11. A developing apparatus as claimed in claim 9, wherein the means for replenishing toner has first and second openings for replenishing toner therethrough, the first opening being disposed in the third region, while the second opening is disposed in the second region.

12. A developing apparatus as claimed in claim 11, wherein the means for replenishing toner replenishes toner independently through the first and second openings, the toner being replenished through the first opening in response to the first toner-concentration signal, while the toner is replenished through the second opening in response to the second toner-concentration signal.

* * * * *